US007465069B2

(12) United States Patent
Li

(10) Patent No.: US 7,465,069 B2
(45) Date of Patent: Dec. 16, 2008

(54) HIGH-POWER LED PACKAGE STRUCTURE

(76) Inventor: Chia-Mao Li, 235 Chung-Ho Box 8-24, Taipei (TW)

( * ) Notice: Subject to any disclaimer, the term of this patent is extended or adjusted under 35 U.S.C. 154(b) by 250 days.

(21) Appl. No.: 11/330,938

(22) Filed: Jan. 13, 2006

(65) Prior Publication Data

US 2007/0165408 A1 Jul. 19, 2007

(51) Int. Cl.
*F21V 29/00* (2006.01)

(52) U.S. Cl. ..... 362/294; 362/373; 362/800

(58) Field of Classification Search ..... 362/294, 362/267, 230, 231, 373, 547, 126, 345, 800; 257/712, 717–722
See application file for complete search history.

(56) References Cited

U.S. PATENT DOCUMENTS 6,340,236 B1 * 1/2002 Hisanaga ..... 362/267
7,128,454 B2 * 10/2006 Kim et al. ..... 362/507
7,244,965 B2 * 7/2007 Andrews et al. ..... 257/98
2006/0139932 A1 * 6/2006 Park ..... 362/294
2007/0133209 A1 * 6/2007 Wang et al. ..... 362/294

* cited by examiner

*Primary Examiner*—Bao Q Truong

(57) ABSTRACT

A high-power LED package structure applied to spot lights, torch lights, structures that provide ultraviolet or infrared or white lights. The high-power LED package structure comprises at least one light emitting diode chip attached to an outer surface of a metallic heat sink of high heat conductivity. The structure further comprises a heat-conducting base on which the metallic heat sink is embedded. There is an insulating layer between the metallic heat sink and the heat-conducting base. The tri-structure significantly increases the mechanical toughness and the heat-conducting area of the present invention, whereby the heat produced in the metallic heat sink will be diffused quickly to the heat-conducting base and then dissipated away. Therefore, the effect of heat dissipation will be enhanced.

6 Claims, 8 Drawing Sheets

HIGH-POWER LED PACKAGE STRUCTURE

FIELD OF THE INVENTION

The present invention relates to high-power LED package structures, more particularly to a high-power LED package structure used as a light source, whereby the mechanical toughness, insulator toughness and heat-conducting area are increased. Therefore, the effect of heat dissipation is enhanced.

BACKGROUND OF THE INVENTION

It is a trend that light emitting diode (LED) is widely used to replace conventional light bulb in various occasions, such as LED projector light source, spot light, traffic signal light and automobile brake light. A light bulb made of LEDs has the advantage of small volume but is limited in luminosity, which limits its application. To increase its luminosity, light source made of a plurality of LEDs is necessary, causing a proportional increase in the operation current. However, the conventional LED light bulbs rely on metallic bracket for the LEDs to dissipate heat, which is not sufficient for an operation at high electric current, and therefore the luminosity is still limited. To operate the LED light bulbs at high current and therefore high luminosity for a long time is easy to burn out the LED chips therein. To tackle this disadvantage, a multi-layer structure wherein the LED chips are attached on a thin copper sheet that is mounted on a metallic block by a gluing material. Therefore, as heat is generated in the chips, it will be transferred quickly downward to the metallic block. However, the design is still not efficient enough, and therefore the durability of the LED chips is still limited.

SUMMARY OF THE INVENTION

The primary objective of the present invention is to provide a high-power LED package structure utilizing LED chips as a light source and powered by a direct current source. The present invention can be used in spot lights, torch lights, structures that provide ultraviolet or infrared or white lights. The present invention comprises at least one LED chip.

The secondary objective of the present invention is to provide a high-power LED package structure wherein the upper end of the lamp shade of the light bulb is provided with a lens made of glass or acrylic. The lens can be selected from a convex, concave and a planar lenses; the lens is easy to replace in accordance with customer's request.

It is a further objective that a high-power LED package structure of the present invention wherein the cup body of the lamp shade is made of plastic or aluminum alloy and has a parabolic inner surface for focusing the light beams from the LED, whereby the present invention can be used to project and focus light in various directions. The cup body of the lamp shade is connected to the heat-conducting base for mounting and protection.

Further, an another objective of the present invention is to provide a high-power LED package structure wherein the heat-conducting base may have a contour selected from a circle, a square or another geometric shape. The contour of the lens, the lamp shade and the heat-conducting base can also be varied.

The various objects and advantages of the present invention will be more readily understood from the following detailed description when read in conjunction with the appended drawings.

DETAILED DESCRIPTION OF THE PREFERRED EMBODIMENTS

Figure 1:
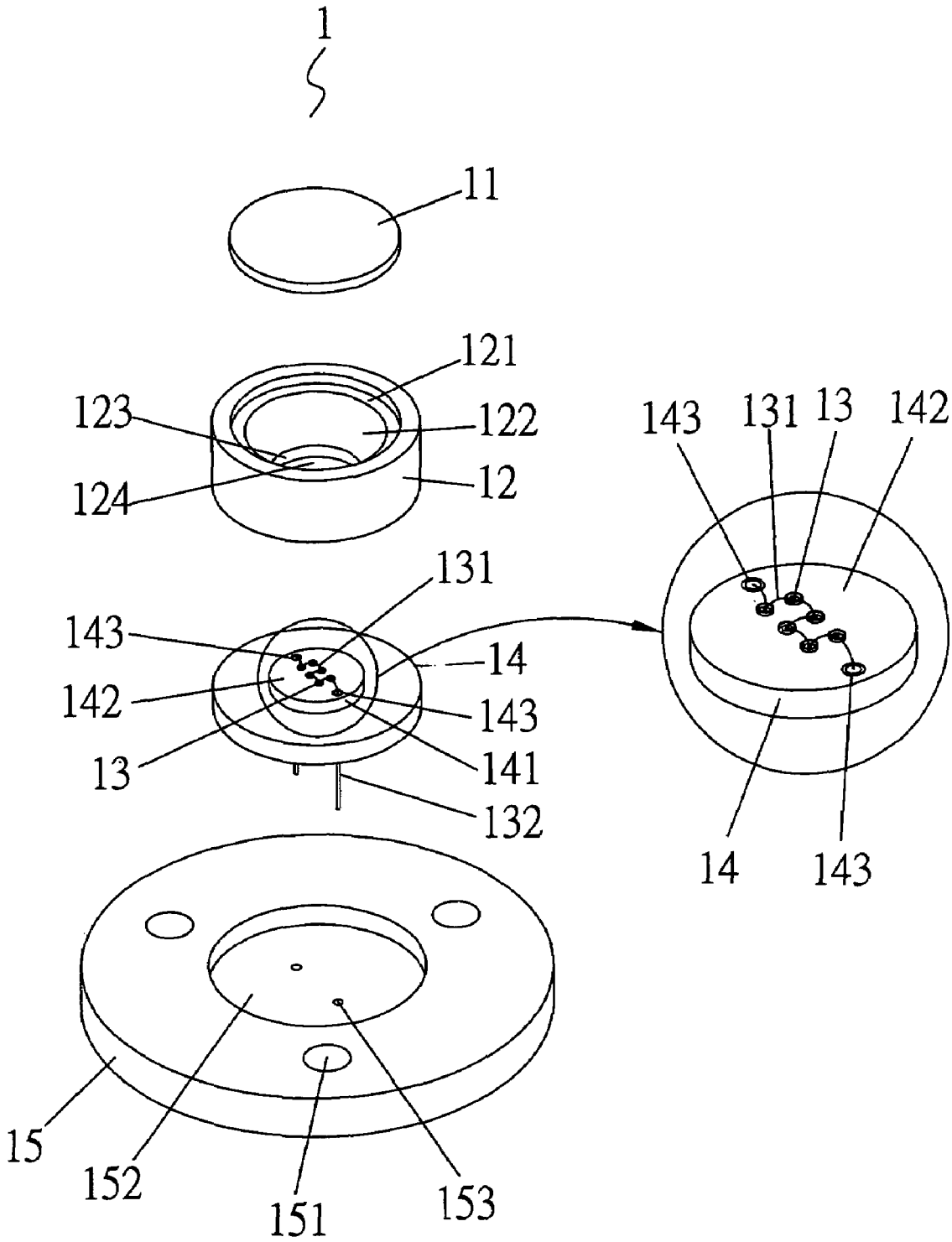
FIG. 1 is an exploded perspective view of a high-power LED package structure of the present invention.
Figure 2:
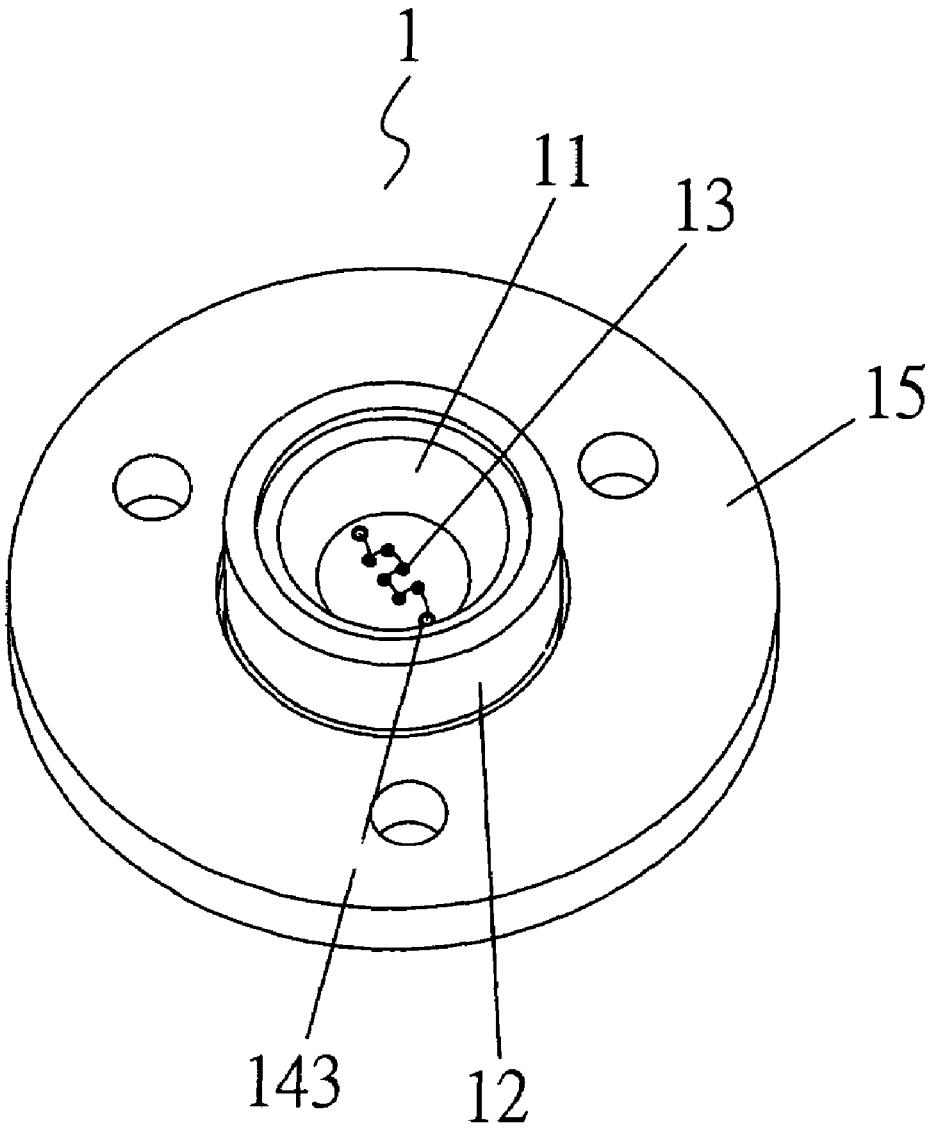
FIG. 2 is a perspective view of the high-power LED package structure in FIG. 1.
Figure 3:
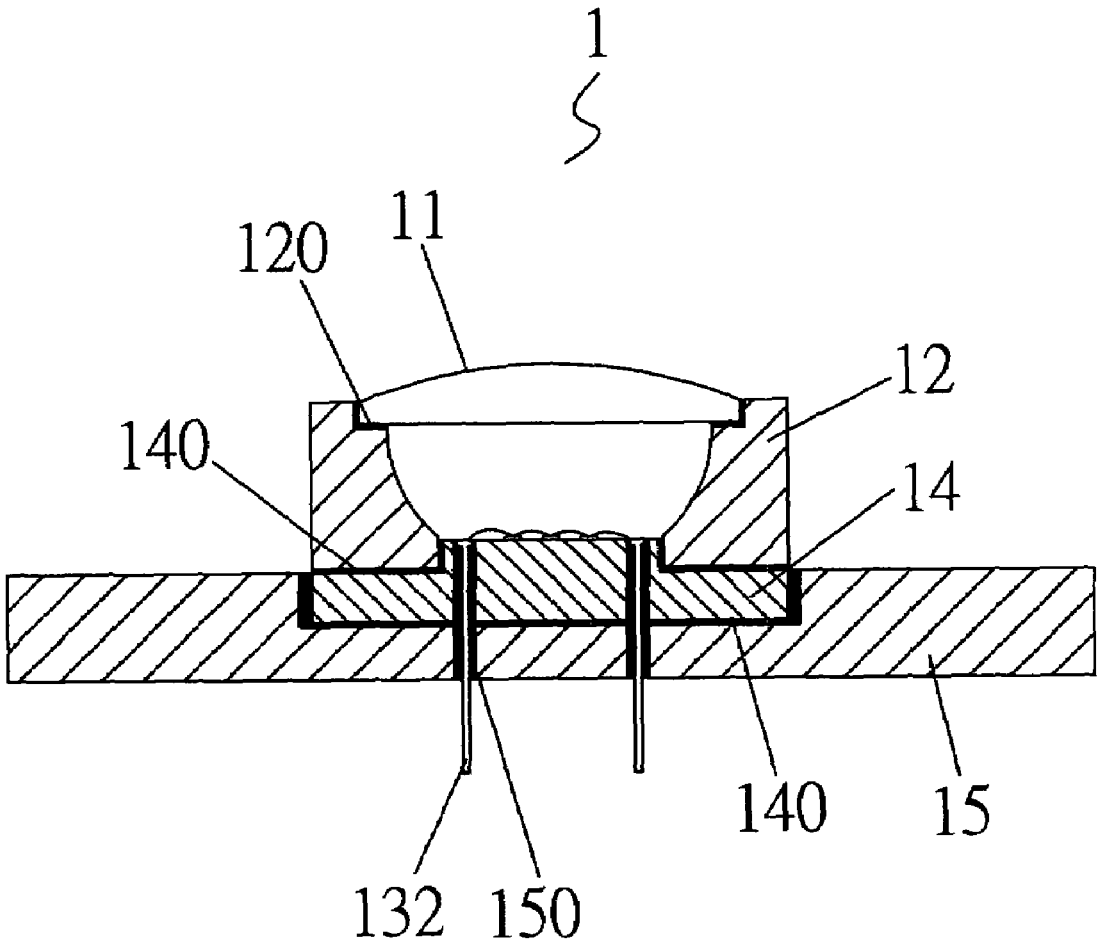
FIG. 3 is a side cross-sectional view of the high-power LED package structure in FIG. 1.

Referring to FIGS. 1, 2 and 3, a high-power LED package structure according to the present invention comprise a lens 11, a lamb shade cup 12, an LED chip array 13, a metallic heat sink 14 and a heat-conducting base 15. The upper surface of the heat-conducting base 15 is circularly arranged with a plurality of through holes 151 for the engagement with respective screws, whereby the LED package structure 1 will be mounted within spot lights, torch lights, structures that provide ultraviolet or infrared or white lights. The heat-conducting base15 is further provided with a central receptacle 152 for housing the metallic heat sink 14. There is a insulating layer 140 sandwiched between the central receptacle 152 and the metallic heat sink 14, whereby the metallic heat sink 14, the insulating layer 140 and the heat-conducting base15 will form a compactly integrated body. Therefore, the mechanical toughness and heat conduction are enhanced, and simultaneously the electric insulating is assured. There is a flat surface formed between the metallic heat sink 14 and the heat-conducting base15; a platform 141 is extended from the flat surface. Near the center of the top surface 142 on the platform 141, there are an LED chip array 13, whose elements are connected by metallic wires 131. The top surface 142 is further provided with a pair of holes 143 for mounting respective brackets 132 by glue layers 150 under the metallic heat sink 14. There are two retaining holes 153 in the heat-conducting base15 for receiving the brackets 132 so that they can go through the heat-conducting base15 to be connected with an external power supply. The upper portion of the metallic heat sink 14 is mounted with a hollow lamb shade cup 12 having a depressed flange 121 around its rim and a curved surface 122 contracting toward its lower portion and ended up with a lower opening 124 with an annular inner wall 123. The lower opening 124 of the lamb shade cup 12 can be engaged with the outer rim of the platform 141 on the metallic heat sink 14, with the annular inner wall 123 attaching the outer lateral wall of the platform 141. There is an insulating layer 140 between the lamb shade cup 12 and the metallic heat sink 14, whereby the lamb shade cup 12, insulating layer 140 and the metallic heat sink 14 will form an integrated body. The depressed flange 121 around the lamb shade cup 12 can be covered with a lens 11 that is attached thereon by a glue layer 120. When two brackets 132 are connected with an external DC power supply, the LED chip array 13 will be powered through the metallic wires 131 and emit light. As a consequence, the LED chip array 13 will generate heat, which will be dissipated by the metallic heat sink 14 by conduction so quickly that the temperature of the LED chip array 13 will not be too high. Therefore, the LED chip array 13 can support a high electric current and have high luminosity. The emitted light will be focused and redirected by the lamb shade cup 12 and the lens 11 with a desired projection angle.

Figure 4:
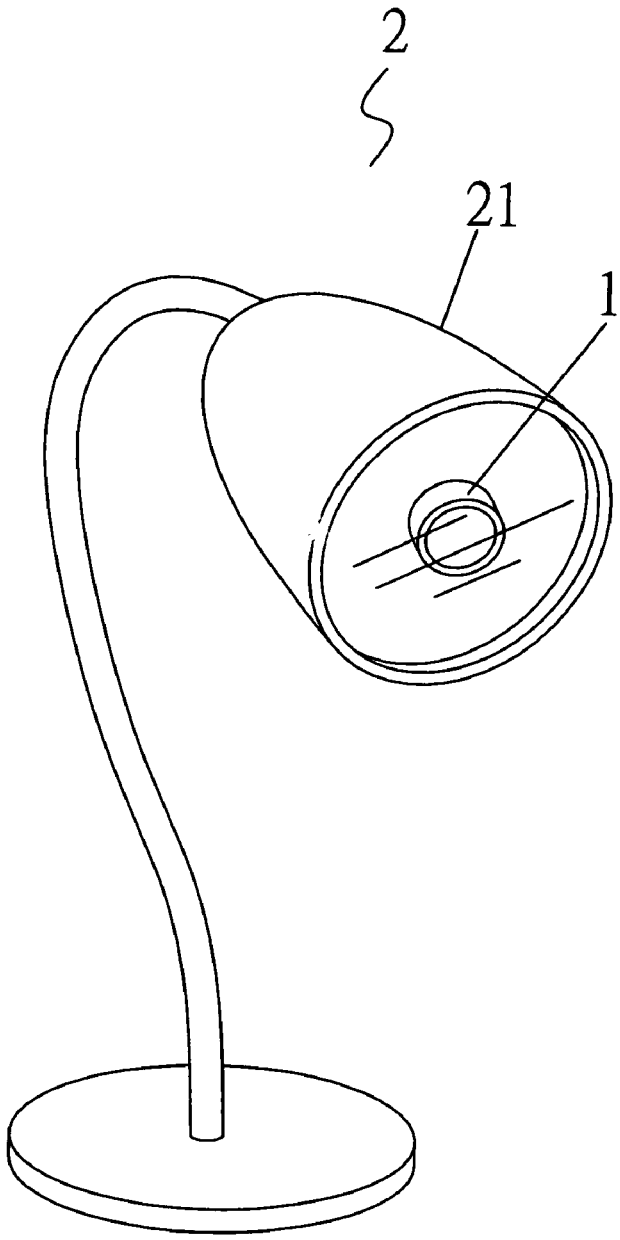
FIG. 4 shows the first preferred embodiment of the present invention.

Referring to FIG. 4, the high-power LED package structure 1 of the present invention is mounted within the round lamp shade 21 of a desk lamp 2 by a screw mechanism. Since the present invention uses a DC power source, the luminosity of the present invention is very stable, and a user's eyes will not be fatigued by light blinking.

Figure 5:
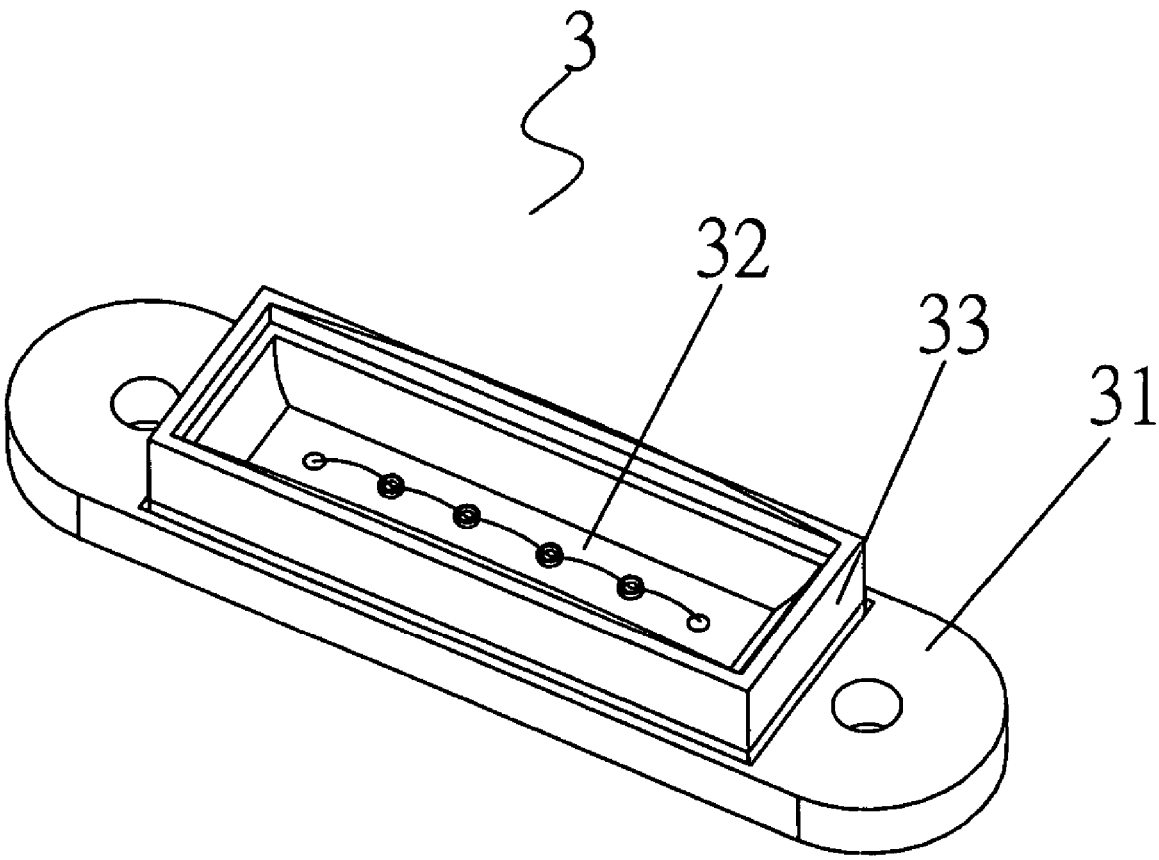
FIG. 5 is a high-power LED package structure of the present invention wherein the LEDs are arranged in a strip.

Referring to FIG. 5, a high-power LED package structure 3 of the present invention has an LED array is in an elongated arrangement mounted within the central receptacle on a metallic heat sink 32 and the heat-conducting base 31 is strip-like. The top surface of the metallic heat sink 32 is provided with a plurality of LED chips, which are electrically connected and have the connecting brackets extend downward out of the heat-conducting base 31. The upper portion of the metallic heat sink 32 attaches a lamp shade cup 33. Therefore, the present invention can transfer heat generated in LED chips outward quickly, and the LED chips, held at a much lower temperature, can sustain a large amount of electric current and become brighter.

Figure 6:
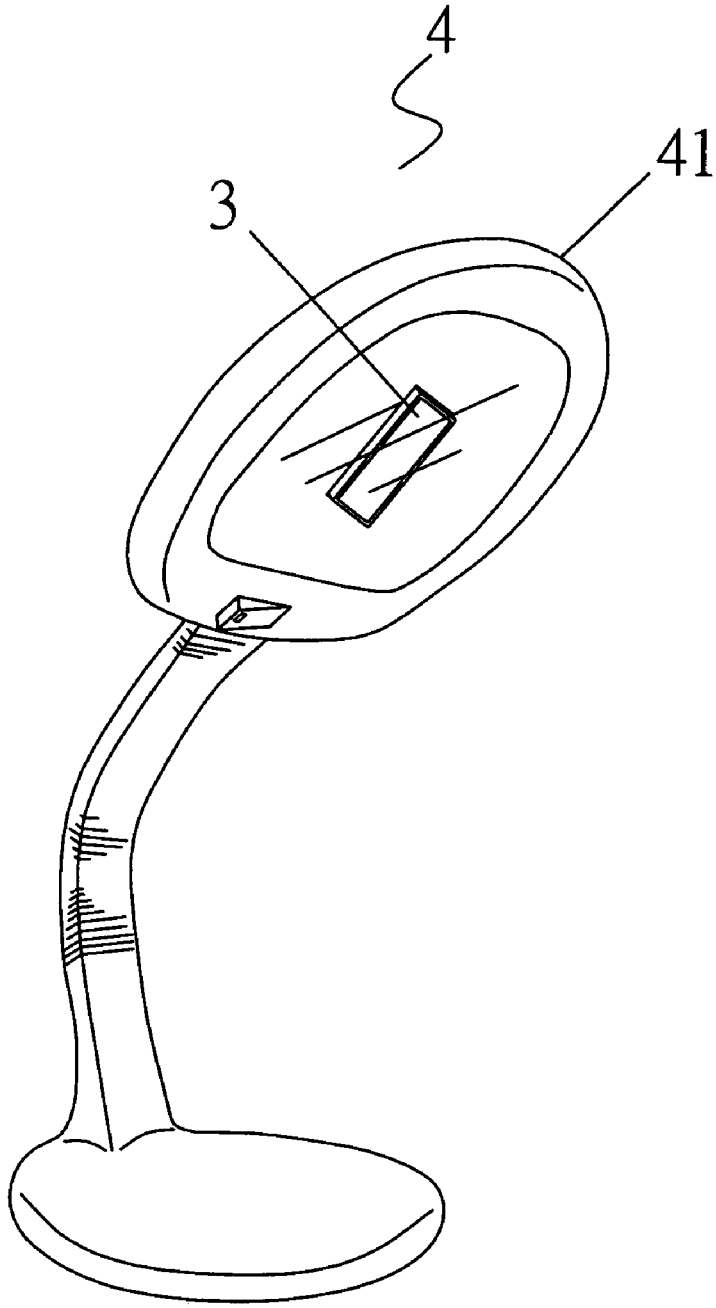
FIG. 6 shows the second preferred embodiment of the present invention.

Referring to FIG. 6, a high-power LED package structure 1, wherein the LED array is in an elongated arrangement, of the present invention is mounted within the rectangular lamp shade 41 of a desk lamp 4 by a screw mechanism.

Figure 7:
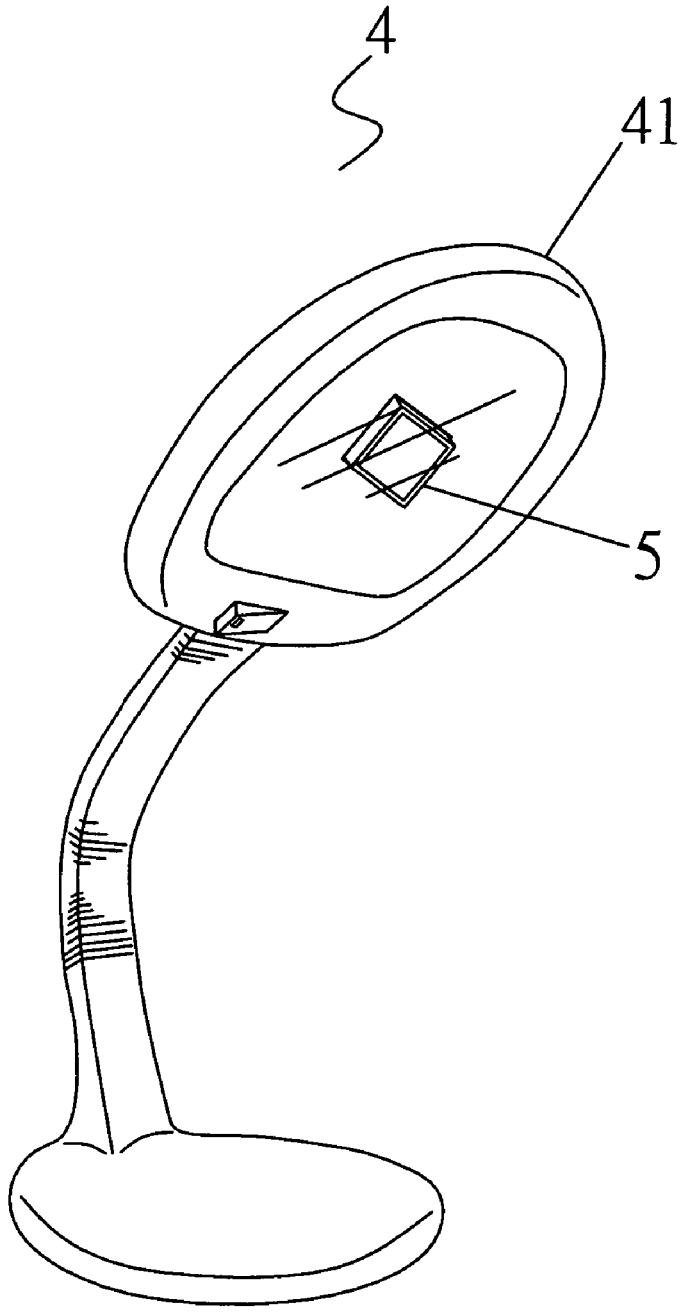
FIG. 7 is a high-power LED package structure of the present invention wherein the LEDs are arranged in a square.

Referring to FIG. 7, a high-power LED package structure 1, wherein the LED array is in a rectangular arrangement, of the present invention is mounted within the rectangular lamp shade 41 of a desk lamp 4 by a screw mechanism.

Figure 8:
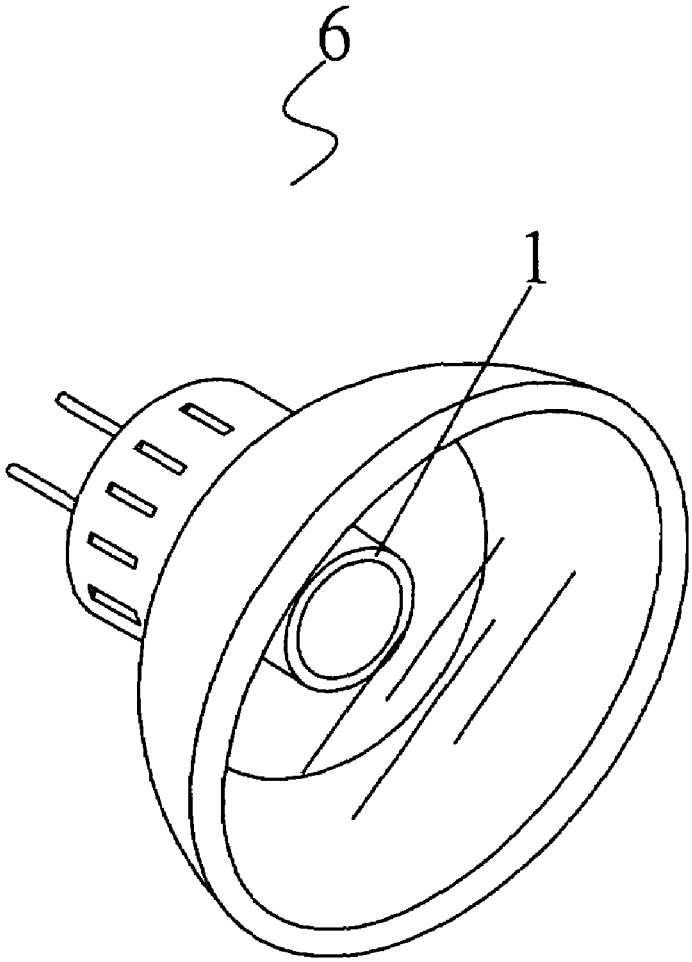
FIG. 8 shows the third preferred embodiment of the present invention.

Referring to FIG. 8, a high-power LED package structure 1 of the present invention is mounted within a spot light bracket 6 by a screw mechanism. Since the heat dissipation of the present invention is efficient, the high-power LED package structure 1 can be operated at high electric current and provides brighter light. Further, the operational current can be adjusted according to a customer's need.

To summarize, the present invention has the following advantages:

The metallic heat sink, the insulating layer, the heat-conducting base and the lamp shade cup are connected to form an integral metallic body capable of transferring heat generated in LED chips outward quickly. Thereby, the LED chips can sustain a large amount of electric current and become brighter.

Since each of the chips can be brighter, the total number of LED chips is limited, and therefore the production cost is lower.

Since the heat conduction is more efficient, the LED chips are at a much lower temperature; therefore, their durability is enhanced.

The heat sink is engaged within a receptacle on the heat-conducting base, between which two a thin layer of insulating material of high thermal conductivity is sandwiched. Therefore, the mechanical toughness and heat conduction are enhanced, and simultaneously the electric insulating is assured.

The present invention is thus described, and it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A high-power LED package structure, comprising:

a lens;

a lamp shade cup;

a light-emitting diode (LED) chip array used as a light source having at least one LED chip;

a metallic heat sink on which said LED chip array is embedded having a volume much larger than said LED chip array, a top surface of said metallic heat sink further including said lamp shade cup covered with said lens, said lens having a preset curvature for projecting light in a predetermined angle; and a heat-conducting base on which said metallic heat sink is mounted, a heat-conducting insulating layer being disposed between said heat-conducting base and said metallic heat sink, whereby mechanical toughness, electric insulating and heat conduction of said high-power LED package structure will be enhanced;

whereby the heat generated in said LED chip array will be quickly transferred to said metallic heat sink and then to said heat-conducting base, and whereby said LED chip array will support a higher electric current and have brighter light intensity; and wherein an upper rim of said lamp shade cup is provided with a depressed flange, and a lower rim of said lamp shade cup is provided with an annular inner surface; said lamp shade cup having a downwardly contracting curved surface; and wherein said metallic heat sink is further provided with a central platform whose upper surface being a supporting surface for said LED chip array; said supporting surface being further provided with a pair of through holes each for passing through a bracket, which brackets are extended out of a bottom surface of said metallic heat sink; said brackets being connected to metallic wires that are connected to said LED chip array.

2. The high-power LED package structure of claim 1 wherein said lamp shade cup and said metallic heat sink are integrated by the heat-conducting insulating layer, whereby said annular inner surface is attached on an outer lateral wall of said platform, and whereby said lower opening of said lamp shade cup is coupled with said platform of said metallic heat sink.

3. The high-power LED package structure of claim 1 wherein said heat-conducting base is further provided with a central, round receptacle for housing said metallic heat sink; said receptacle further including a pair of holes for retaining two bracket legs linked to said LED chip array; said heat-conducting base and said metallic heat sink sandwiching the heat-conducting insulating layer, forming a flat surface between them; said flat surface further including an uprightly bulged platform.

4. The high-power LED package structure of claim 1 wherein two bracket legs are extended out of a bottom surface of said heat-conducting base; said brackets being inserted through two holes on said heat-conducting base and secured by respective glue layers therein.

5. The high-power LED package structure of claim 1 wherein an outer boundary on a top surface of said heat-conducting base is provided with a plurality of holes for the insertion of respective screws; thereby, said high-power LED package structure being capable of being be used in spot lights, torch lights, structures that provide ultraviolet or infrared or white lights.

6. The high-power LED package structure of claim 1 wherein said heat-conducting base takes a shape selected from a circle, a square, an elongated rectangle and any other shape; said lens, said lamp shade cup and said metallic heat sink may take a shape according to the shape of said heat-conducting base.

* * * * *